US007523782B2

(12) United States Patent
Lorentz et al.

(10) Patent No.: US 7,523,782 B2
(45) Date of Patent: Apr. 28, 2009

(54) HEAT EXCHANGER HAVING A DOUBLE BAFFLE

(75) Inventors: Jay Lorentz, Shelbyville, IN (US); Bradley A. Smith, Columbus, IN (US)

(73) Assignee: Valeo, Inc., Ann Arbor, MI (US)

( * ) Notice: Subject to any disclaimer, the term of this patent is extended or adjusted under 35 U.S.C. 154(b) by 535 days.

(21) Appl. No.: 10/902,972

(22) Filed: Jul. 31, 2004

(65) Prior Publication Data

US 2006/0021746 A1 Feb. 2, 2006

(51) Int. Cl.
*F28F 9/22* (2006.01)

(52) U.S. Cl. ..... 165/174; 165/70

(58) Field of Classification Search ..... 165/70, 165/174

See application file for complete search history.

(56) References Cited

U.S. PATENT DOCUMENTS

| | | | | | |
|---|---|---|---|---|---|
| 4,141,409 | A * | 2/1979 | Woodhull et al. | ..... | 165/110 |
| 4,825,941 | A * | 5/1989 | Hoshino et al. | ..... | 165/110 |
| 4,947,931 | A | 8/1990 | Vitacco | | |
| 5,123,483 | A * | 6/1992 | Tokutake et al. | ..... | 165/176 |
| RE35,742 | E * | 3/1998 | Hoshino et al. | ..... | 165/150 |
| 6,019,171 | A * | 2/2000 | Johnson | ..... | 165/174 |
| 6,082,447 | A | 7/2000 | Insalaco et al. | | |
| 6,119,340 | A | 9/2000 | Insalaco et al. | | |
| 6,289,980 | B1 * | 9/2001 | Insalaco et al. | ..... | 165/174 |
| 2004/0251015 | A1 * | 12/2004 | Bonnet | ..... | 165/174 |
| 2005/0211425 | A1 * | 9/2005 | McKittrick et al. | ..... | 165/174 |

FOREIGN PATENT DOCUMENTS

| | | | |
|---|---|---|---|
| EP | 0789 213 B1 | | 12/2002 |
| JP | 05272889 A | * | 10/1993 |
| WO | WO 00/29801 | | 5/2000 |

* cited by examiner

*Primary Examiner*—Allen J Flanigan
(74) *Attorney, Agent, or Firm*—Dierker & Associates, P.C.

(57) ABSTRACT

There is disclosed a heat exchanger for transferring heat between at least two fluids and a method for forming the heat exchanger. The heat exchanger preferably includes one or more end tanks, one or more inlets and outlets, one or more tubes, one or more fins, and one or more improved baffle combinations including at least one single piece double baffle.

The improved single piece double baffles act as part of a baffle system, with advantages over multiple-piece only double baffle systems due to being assembled in one piece.

11 Claims, 5 Drawing Sheets

HEAT EXCHANGER HAVING A DOUBLE BAFFLE

FIELD OF THE INVENTION

The present invention relates generally to a heat exchanger and, more particularly, a multi-fluid heat exchanger, employing at least one single piece double baffle.

BACKGROUND OF THE INVENTION

In the automotive industry, in particular, it has become increasingly necessary to combine multiple functions in a single heat exchanger assembly. The need to reduce the number of overall components and to optimize assembly efficiency has driven the need for improved heat exchanger devices that combine increasingly efficient designs and multiple functions in packaging heretofore attainable using plural separate components or devices having inefficient designs. More specifically, there has been a growing need for an improved heat exchanger device, particularly for under the hood automotive vehicle applications, which combines multiple functions in a single assembly that is efficient to make and operate and that occupies substantially the same or less space than existing heat exchanger devices. Due to relatively recent advancements in the field, including, in particular, the development of combination heat exchanger assemblies or 'combo coolers', there is also a need to develop systems of more than one baffle to insure that multiple fluids be maintained basically separated from one another.

As stated above, particularly where a multi-fluid heat exchanger is to be employed, it is attractive to be able to maintain each of the different fluids of the exchanger separated from each other. The employment of baffles is one possible approach. However, until the present invention, double baffle designs have often resulted in space problems, and the like, contributing to the loss of function or efficiency of one or more of the heat exchanger tubes. In particular, certain heat exchanger assemblies may have space requirements that extend to at least one core tube-end in the tank.

Furthermore, in multi-fluid heat exchanger assemblies, an internal solution has often been to insert, during assembly, at least two separate pieces, to form a so called double baffle. A first and a second baffle can be assembled back to back with a common center contact portion.

Such a double baffle is in actuality, therefore, a double piece double baffle, as the two separate baffles have a space between the pieces to ensure that one fluid in the separate fluid systems remains separated from the other. To provide most effective functioning of such a system, a 'weep hole' must often be placed on the cover surface of the heat exchanger manifold, between the pieces of the double baffles, in order to let flux enter prior to brazing and to serve a potential leak detection function. This has caused a problem, however, since the double piece double baffle needs to be affixed in some manner to maintain its position to perform their function, and positional control needs to be optimized to allow for reduced tube pitches, especially in higher performance heat exchanger assembly applications. Thus, it would be especially desirable for an improved baffle design that can be incorporated into a heat exchanger, and particularly a multi-fluid heat exchanger, which makes efficient use of all heat exchanger tubes and solves this positional control problem.

As described above, some automotive heat exchangers have evolved to contain two or more separate fluids for heat exchange, the fluids separated by a baffle internal to the heat exchanger. It is an object of the present invention, therefore, to keep multiple fluids within a multi-fluid heat exchanger separate, and, if unsuspected or inadvertent leaks do occur, to insure that internal fluids remain separated, so that a leaking fluid 'leaks' to the exterior or atmosphere outside of the heat exchanger and not into an internal area of the heat exchanger where it could mix with or 'contaminate' other fluids.

Thus, it would be especially desirable for an improved double baffle design that can be incorporated into a heat exchanger, and particularly a multi-fluid heat exchanger, which remains efficient while keeping the fluids separated from one another. It would also be desirable to provide for a heat exchanger with baffles that keep fluids separated such that a leak of one or more fluids from the heat exchanger will not result in a contamination of any other fluid inside the heat exchanger, since cross contamination can lead to catastrophic failure of one or more on the systems cooled by a heat exchanger.

As disclosed above, it has been found that leaks and mixing or contamination between fluids can lead to inefficient or less that optimal heat exchanger performance, as well as damage to the vehicle and customer discomfort. There are problems with heat exchanger designs, and especially heat exchanger designs that employ multiple baffles, as some of the designs solve the problem of leaks by allowing leaks to the atmosphere; while subsequently providing for two separate baffles with spaces in-between to avoid the problem of leaks between the parts of the exchanger. However, such designs either take up a large amount of space (EP0789213) or do not allow an adequate gap or space to efficiently function.

In addition, the gaps or spaces between the baffles are susceptible to filling with flux and/or braze materials during manufacture during the braze cycle. The result of such gap filling can lead to temporary blockages of the gap or space, meaning that the fluids, in case of leak at the double baffle, cannot leak through the gap or space into the atmosphere, and, therefore, lead to inefficient or less effective functioning.

OBJECTS OF THE INVENTION

It is an object of the present invention to solve a problem that has been discovered in other heat exchangers that relates to the fact that in some double baffle configurations, the use of two separate parts to create an appropriate or less than optimal space or 'gap' leads to handling and manufacturing difficulties due to the size of the individual and collective baffles and the need for the baffles to be placed in relative proximity to one another.

In preferred embodiments of the present invention, it is a further object not only to solve the problem of separation of fluids and prevention of contamination, but also potential problems of inefficient or less effective functioning of baffles caused by temporary blockages of the gap or space normally open to the atmosphere outside of the heat exchanger. In more preferred embodiments of the present invention, the present invention provides for a heat exchanger comprising a single piece double baffle, wherein the double baffle design allows for a sufficient gap to allow leaks to atmosphere, while also being cost effective and relatively easy to manufacture and assemble.

SUMMARY OF THE INVENTION

The present invention is directed to a heat exchanger for an automotive vehicle. The heat exchanger includes a first end tank divided into a first portion and a second portion by a baffle, the first end tank preferably having a through-hole or 'weep hole'. The heat exchanger also includes a plurality of first tubes in fluid communication with the first portion of the first end tank, the plurality of first tubes configured to have a first fluid flow there through. Preferably, a plurality of second tubes are in fluid communication with the second portion of the first end tank, the plurality of second tubes configured to have a second fluid, the same or different from the first fluid, preferably different flow there through. It is also preferable for the heat exchanger to include a plurality of fins disposed between the first tubes and the second tubes.

Baffles may be used in single fluid or multi-fluid heat exchangers. In particular, in combo coolers, a common tank section often needs a separator between the separate fluid systems. It has been found that a baffle, or, in particular, a double (or multiple) baffle system, can be used that provides the separation of fluids necessary for adequate functioning of heat exchanger for each fluid. Preferably, in combination heat exchanger assembles or combo coolers, a single piece double baffle may be used to ensure that the separate fluids of the multi-fluid systems remain essentially separated from one another, while avoiding the problem of inadequate separation caused by blockage of the space or gap between baffles or baffle profiles.

The baffle system of the present invention includes a one piece baffle, and, particularly, a single piece double baffle, that can be easily assembled and provides a high level of positional and dimensional control in order to allow for reduction in heat exchanger tube core tube pitch. It is understood that a single piece baffle is essentially formed into one piece prior to assembly into the heat exchanger tank. In preferred aspects of the present invention, the single piece double baffle is placed between adjoining tubes to separate the fluids. The space available for baffle placement is dependent on the tube spacing, or tube pitch as it is also known. A reduction in tube pitch generally increases the performance of the heat exchanger, but provides less space for a double baffle. The present invention, by improving the positional and dimensional tolerance of the double baffle on the end tank or 'manifold' allows more efficient allocation of the space to the function of the double baffle. Therefore, it is one object of the present invention to have a single piece double baffle that can be easily assembled and provide positive positional control, as well as size control, to allow further reductions in the core's tube pitch, and to ensure proper functionality by preventing contamination or mixing of the separate fluids contained, for example, in a combo cooler assembly.

The single piece double baffle design actually is made of a single piece of metal rather than the traditional two piece design. This part can be machined, extruded and machined, or cast to shape. This allows for a wider gap due to the reduced tolerances required compared to other manufacturing methods (primarily stamping), and also due to the increased typical post-braze strength of extruded or cast alloys. This higher strength means that wall thicknesses can be lowered, allowing for the greater gap. A single piece of metal, as used in the single piece double baffle of preferred embodiments of the present invention, also leads to more consistently predictable outcomes than would be expected using baffles having, for examples two separate pieces of metal.

In a particular embodiment of the invention, a "hole" or "weep hole" may be placed on the cover surface between double baffles, to provide a communication towards the exterior. In an even more preferred embodiment, the entry passage is placed on the cover surface so as to enable entry of liquid materials such as flux, to prepare any wetted surfaces for brazing or the like. An additional preferred feature and advantage of such an embodiment is that said entry passage may also provide a means to facilitate leak detection. In preferred embodiments, the double baffle has an outer perimeter edge separated by a short distance to provide a relief channel at the sealing edge. The sealing perimeter outward variance of preferred embodiments also provide greater axial stability of the baffle during assembly.

In preferred embodiments of the present invention, the walls of the one piece double baffle form at least one chamber or gap. The at least one chamber is preferably formed in a bend or bend like shape, e.g. a shape having two sides and a closed end form to a chamber, in for example, a U, V or H like shape. In such shapes, and preferably in a U, V or H like shape, the shape is conventionally determined by looking at it perpendicular to the manifold of each exchanger section. In preferred embodiments, bends can be added to the basic shape to allow for a more stable assembly. Additional bends can be added to fit into the space between adjacent tubes of each exchanger. It is preferable that at least one of the profiles of the single piece double baffle matches the shape of the manifold cross-section; it is more preferable that both profiles of the single piece double baffle match the shape of the manifold cross-section. It has been found that by matching the shape of the manifold to the profile of the single piece double baffle that a sealing surface is formed when brazed.

In preferred embodiments of the present invention, the single piece double baffle is shaped to form a single part that contains all the advantageous features of the two piece double baffle design, while avoiding some of the most egregious disadvantages of such designs. By using tighter dimensional control that is available in a single part, combined with the greater strength available in materials such as an extruded or cast aluminum materials, the single piece double baffle presents advantages not found in heretofore used designs. In more preferred embodiments, at least one single piece double baffle further comprises a means to allow passage of fluid from the interior of the baffle or the baffle 'chamber', to the outside of the end tank (manifold).

Preferably, the single piece double baffle provides a shape that can be held easily by tooling to allow the precise and automatic assembly into the manifold assembly. This shape, in addition to the need for only one part, allows for automatic assembly of the part, or greatly improved manual assembly of the part. In particularly preferred embodiments of the present invention, a wider portion of a single piece double baffle beyond the tube walls provides for the largest gap possible between the two separate heat exchanger sections that can be used to advantage.

Preferably, the single piece double baffle is made out of one piece of continuous material. Preferred materials for use in making the single piece double baffle include metals or metallic materials, or alloys of such materials. More preferred are metals or metallic materials or alloys of such materials that can be employed in assembly processes using soldering, brazing or welding processes. Most preferred are metals such as aluminum or aluminum alloys. Some processes that can be used in preferred embodiments of the present invention include soldering, induction brazing or vacuum brazing, or press fitting in a mechanically assembled heat exchanger (non brazed).

It is also preferred that the single piece double baffle be made from a flat or planar section or piece of material. In more preferred embodiments, a flat piece of metal is stamped or otherwise shaped, to form a single piece double baffle with profiles that contour to the available space within the end tank (or baffle) assembly. In the more preferred embodiments, the profiles of the single piece double baffle are downwardly projecting in similar planes, in other preferred embodiments each baffle profile is approximately parallel to one another.

The baffles used in the heat exchanger of the present invention can be produced using many different methods, including casting, sintering, forging, extruding, machining, or others. More preferably the baffles are produced by extruding or machining.

The shape and thickness of the walls of the baffle do not need to be equal. Preferably, the shape of the walls of the baffle are parallel, but more preferably matching the available space or following the available space contours within the end tank (manifold) assembly in order to provide the largest possible gap between the two heat exchanger portions. Also, preferably, the thickness of the walls is minimized to the lowest possible thickness that will allow for the function of the heat exchanger to withstand pressure and contain fluid (e.g. refrigerant, oil, water, glycol, and the like). More preferably the gap between the walls of the baffle for brazed heat exchangers will be at least twice the radius of a typical braze joint, as this will prevent the gap between the baffles from brazing solid with material, the gap brazing solid (i.e. not allowing free exit of fluid) being one of the major problems of other double baffle designs.

BRIEF DESCRIPTION OF THE DRAWINGS

FIG. 1 is a perspective view of prior art spaced baffles with dead tube in between;

DETAILED DESCRIPTION OF THE PREFERRED EMBODIMENT

Figure 1:
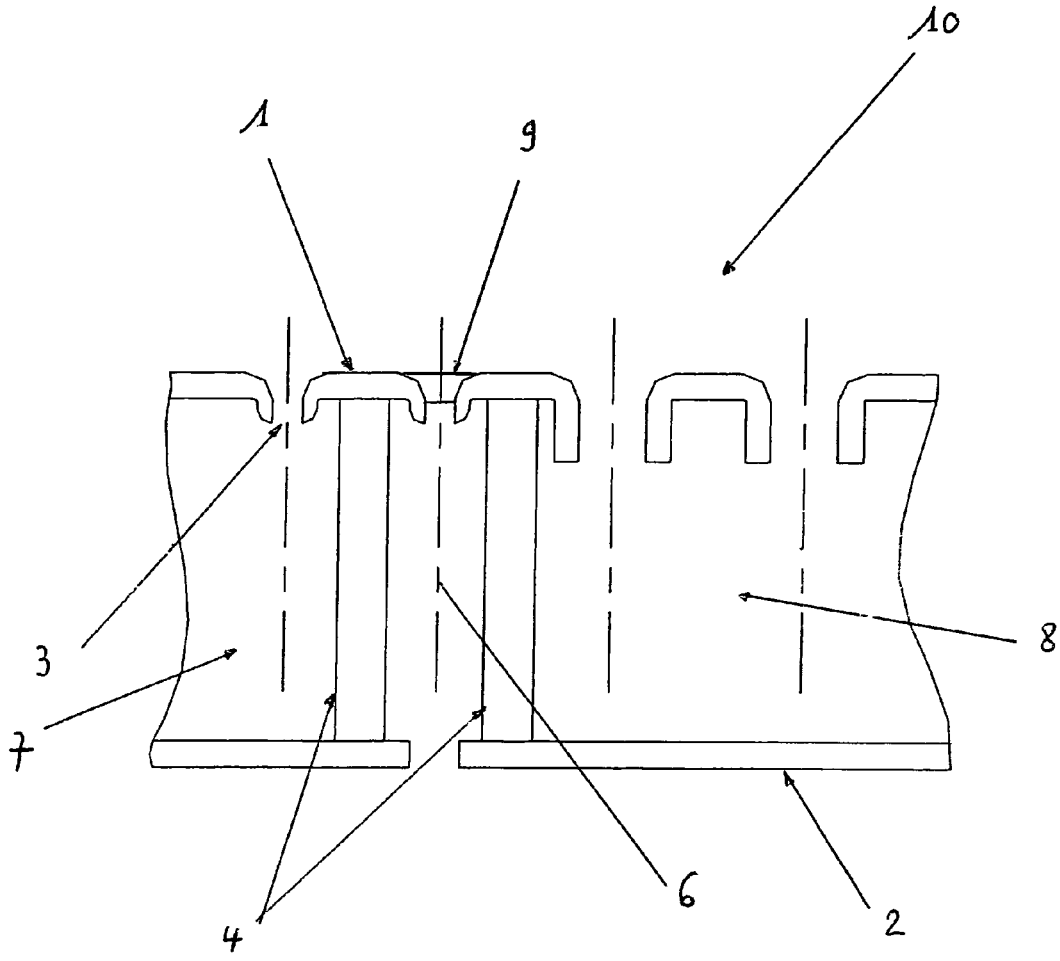

Generally, the present invention relates to a heat exchanger having a baffle system and to a method of forming the heat exchanger. The heat exchanger may be a single fluid or multi-fluid (e.g., 2, 3 or 4 fluid) heat exchanger. The heat exchanger may also be a single pass or multi-pass heat exchanger. Although the heat exchanger according to the present invention may be used for a variety of articles of manufacture (e.g., air conditioners, refrigerators or the like), the heat exchanger has been found particularly advantageous for use in automotive vehicles. For example, the heat exchanger may be used for heat transfer of one or more various fluids within a vehicle such as air or gasses, oil, transmission oil, power steering oil, radiator fluid, refrigerant, combinations thereof or the like. For example, in a highly preferred embodiment of the present invention there is contemplated a multi-fluid heat exchanger that includes an oil cooler or condenser in combination with an oil cooler selected from the group consisting of a power steering oil cooler, a transmission oil cooler, a radiator fluid cooler or a combination thereof. In general, a preferred heat exchanger contemplates at least two spaced apart end tanks (manifolds) bridged together in at least partial fluid communication by a plurality of generally parallel tubes, with fins disposed between the tubes.

In other embodiments of the present invention, the heat exchanger comprises a single piece double baffle, heat exchanger tube, and employs a bypass. Heat exchangers of the present invention will typically include one or more tubes, one or more end tanks, one or more inlets and outlets, one or more single piece double baffles, one or more fins or a combination thereof. Depending upon the embodiment of the heat exchanger, various different shapes and configurations are contemplated for the components of the heat exchanger. For example, and without limitation, the components may be integral with each other or they may be separate. The shapes and sizes of the components may be varied as needed or desired for various embodiments of the heat exchanger. Additional variations will become apparent upon reading of the following description.

The present invention, in preferred embodiments, therefore, comprises a first end tank; a second end tank opposite the first end tank; a plurality of first tubes in fluid communication with the first and second end tanks; a plurality of second tubes in fluid communication with the first and second end tanks; a plurality of fins disposed between the first and second tubes, with the first and second tubes and the fins preferably being generally co-planar relative to each other; and at least one double baffle in at least one of the end tanks. The single piece double baffle divides at least one end tank into a first portion and a second portion. A preferred single piece double baffle has portions with walls that are preferably parallel to, more preferably symmetric about the centerline of the baffle or essentially follow the contours of the interior of the end tank, even more preferably symmetric about the centerline of the baffle.

In preferred embodiments, a gap or chamber is present between the walls of the one piece double baffle. Also in preferred embodiments, at the junctions between the baffle and the end tank, a joint, such as a braze joint, can be formed. In particularly preferred embodiments of the present invention, the junction is a braze joint and the gap between the walls of the baffle is at least twice the radius of the braze joint.

Figure 2:
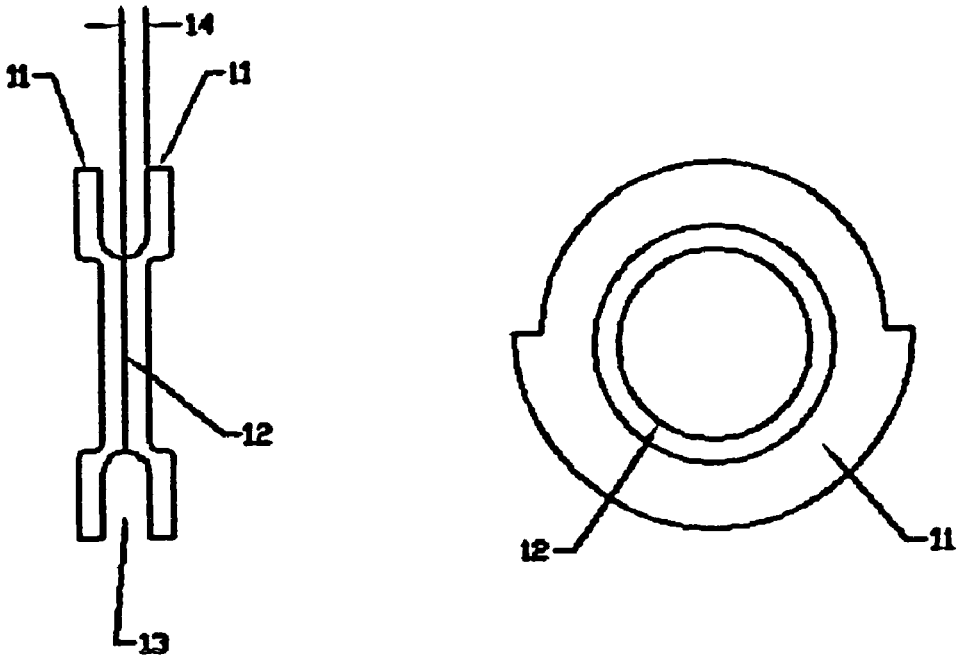
FIG. 2 is a perspective and cross sectional view of a two piece double baffle with specific edge perimeter periphery portion and center contact portion.

As described herein, the preferred embodiments of the present invention comprise heat exchangers, and, in particular, heat exchangers for use in automotive applications, wherein the walls of the one piece double baffle form at least one gap or chamber. In preferred embodiments of the present invention, the gap or chamber is in a bend or bend like shape. More preferred is a bend or bend like shape that forms a gap or chamber with shapes that are formed in line with the one piece double baffle inner walls, which are preferably parallel to, more preferably symmetric about the centerline of the baffle or essentially follow the contours of the interior of the end tank, even more preferably symmetric about the centerline of the baffle, as described above. Even more preferred are gaps or chambers with basic shapes that are U, V or H like. Non-limiting examples of the basic shapes of the gaps or chambers are shown in FIG. 2 for U shape, FIG. 4 for V shape, and FIG. 3 for H shape.

As described herein, more preferred embodiments of the present invention use one piece double baffles made out of a flat or planar section or piece of material, or made from one piece of continuous material.

Also preferred are embodiments of the present invention having a heat exchanger comprising: a first end tank; a second end tank opposite the first end tank; a plurality of first tubes in fluid communication with the first and second end tanks, the plurality of first tubes adapted to have a first fluid flow therethrough; a plurality of second tubes in fluid communication with the first and second end tanks, the plurality of second tubes adapted to have a second fluid flow therethrough; a plurality of fins disposed between the first, second and third tubes, with the majority of fins being generally co-planar relative to each other; and at least one single piece double baffle in at least one of the end tanks. The single piece double baffle preferably divides at least one end tank into a first portion and a second portion. Also, preferably, the first end tank and the second end tank each include at least one single piece double baffle. In other preferred embodiments, a heat exchanger in accordance with the present invention has a plurality of third tubes in fluid communication with the first and second end tanks, the plurality of third tubes adapted to have a third fluid, different from the first or second fluid, flow therethrough.

According to one aspect of the invention, one or more of the components of the heat exchanger such as the baffles, the end tanks, the tubes, the inlets, the outlets, a bypass or combinations thereof may be attached to each other using techniques such as soldering (e.g. zinc coating of aluminum and then heating to fuse parts) and/or brazing techniques. In preferred embodiments of the present invention, profiles of the single piece double baffle are formed whereby the manifold and baffle profile shapes provide for a sealing surface through a brazing process or technique. Although various brazing techniques may be used, one preferred technique is referred to as controlled atmosphere brazing. Controlled atmosphere brazing typically employs a brazing alloy for attaching components wherein the components are formed of materials with higher melting points than the brazing alloy. The brazing alloy is preferably positioned between components or surfaces of components to be joined and, subsequently, the brazing alloy is heated and melted (e.g., in an oven or furnace, via an induction coil, or the like, and, preferably, under a controlled atmosphere). Upon cooling, the brazing alloy preferably forms a metallurgical bond with the components for attaching the components to each other. According to one highly preferred embodiment, the brazing alloy may be provided as a cladding on one of the components of the heat exchanger. In such a situation, it is contemplated that the components may be formed of a material such as a higher melting point aluminum alloy while the cladding may be formed of a lower melting point aluminum alloy. In certain embodiments, where no cladding is used, base metals may be directly melted to one another.

As described herein, preferred embodiments of the present invention are where the single piece double baffle has portions with walls, a gap between the walls, and wherein the heat exchanger is made by brazing or soldering.

In general, a preferred heat exchanger contemplates at least two spaced apart end tanks bridged together in at least partial fluid communication by a plurality of generally parallel tubes, with fins disposed between the tubes.

Referring to FIG. 1, there is shown a cross section of a combination cooler assembly manifold, which consists of a header (1) and a cover (2). The header has a plurality of tube slots (3) into which are placed heat exchanger tubes. Inside of this manifold are two separate double baffles (4), used to separate the two sections of the heat exchanger (7, 8). Between these two double baffles (4) is an open space (6) that allows any leak from either of the two heat exchanger sections to pass to the exterior of the part (10) through a weep hole (5) or through an non-functional tube slot (9). In this prior art design, a heat exchanger tube must be sacrificed at the non-functional tube slot (9) due to the space required to leave the empty void (6).

Referring to FIG. 2, there is a double piece double baffle that does not require as much space to separate the two fluids, but it has been found to have the disadvantages of being difficult to assemble, while also allowing for a less effective gap between the baffles.

The double piece double baffle (11) includes a common center contact portion (12) between two separate double baffles. Additionally, it includes a peripheral gap (13) that is created by the back to back steps in the double baffle.

Figure 3:
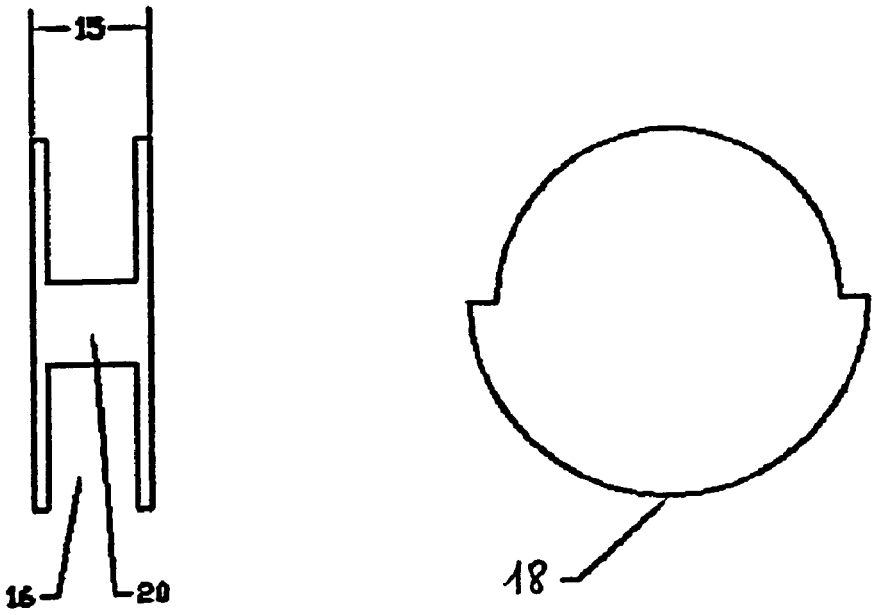
FIG. 3 is a perspective and cross sectional view of a double baffle for a heat exchanger, in accordance with an aspect of the present invention.
Figure 4:
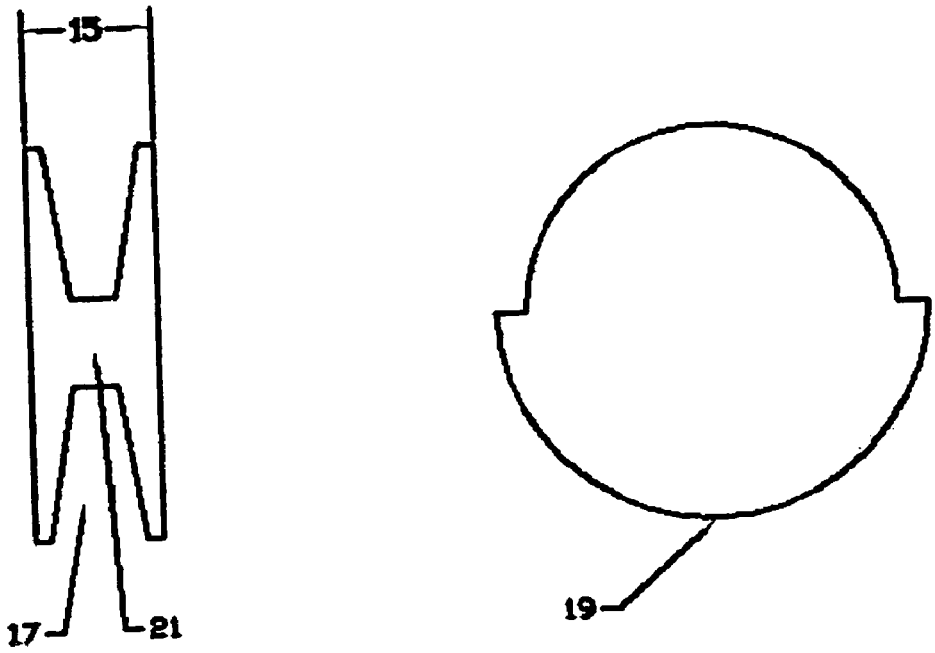
FIG. 4 is a perspective and cross sectional view of a double baffle for a heat exchanger, in accordance with an aspect of the present invention.

In a preferred embodiment of the present invention, and referring to FIGS. 3 and 4, an extrusion bar is made to the shape of the heat exchanger manifold. The heat exchanger manifold may be of virtually any shape, such as round, square, rectangular, triangular, circular or oval, cylindrical, or a multitude of other shapes. The extrusion bar is cut or machined to width (15), and said width is matched to the available space between tubes within the heat exchanger manifold. It is then machined with a gap in the middle (16,17), forming a gap of large enough size that it cannot be fully filled with braze material or braze flux when following conventional brazing techniques for heat exchangers. Optionally, the gap can be machined first, prior to cutting off of the single piece double baffle. The gap can be of various configurations. FIG. 3 shows a straight gap (16). The gap (17) as shown in FIG. 4, is preferably made to match the strength requirements of the baffle so that the single piece double baffle may withstand normal pressures applied to it via fluids in the heat exchanger. Both single piece baffles shown in FIGS. 3 and 4 have a center section common to both sections of the single piece baffle (20,21) as well as a perimeter of various shapes (18,19) that is designed to roughly match the interior shape of the heat exchanger manifold, allowing it to properly braze in a standard braze process.

Figure 5:
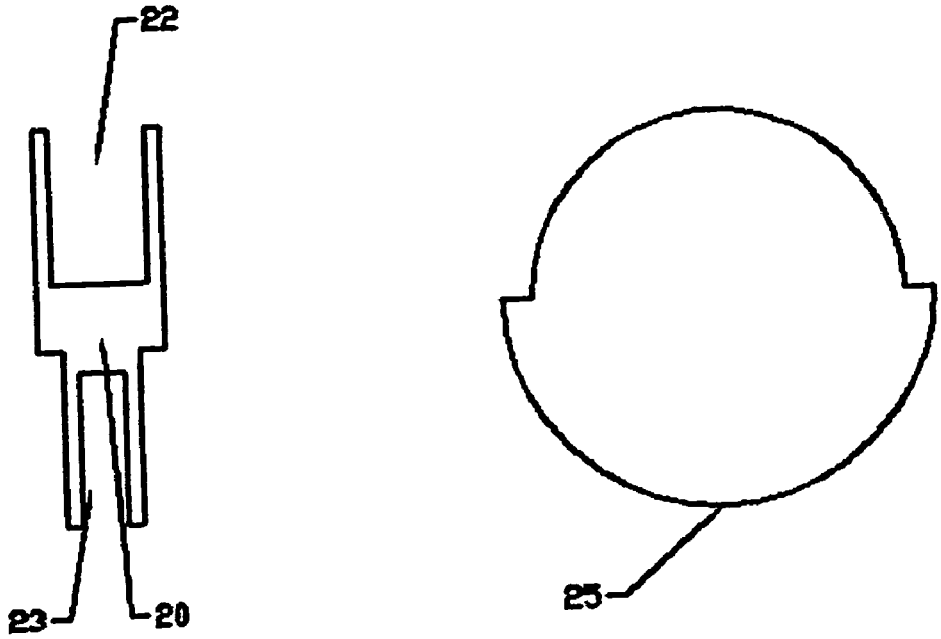
FIG. 5 is a perspective and cross sectional view of a heat exchanger comprising a single piece double baffle, in accordance with an aspect of the present invention.

As shown in FIG. 5, another configuration of a single piece double baffle can be made to make better use of the space available within the heat exchanger manifold. This shape of baffle has a larger gap (22) where space allows it, and a minimum size gap (23) where space dictates a tighter design. The single piece double baffle has common center section (24) between its two sections. For use in heat exchanger embodiments of the present invention, the aforementioned embodiment of the single piece double baffle may be made by processes named above, such as extrusion and machining processes, or it can be made by casting, sintering, etc., or like processes.

Figure 6:
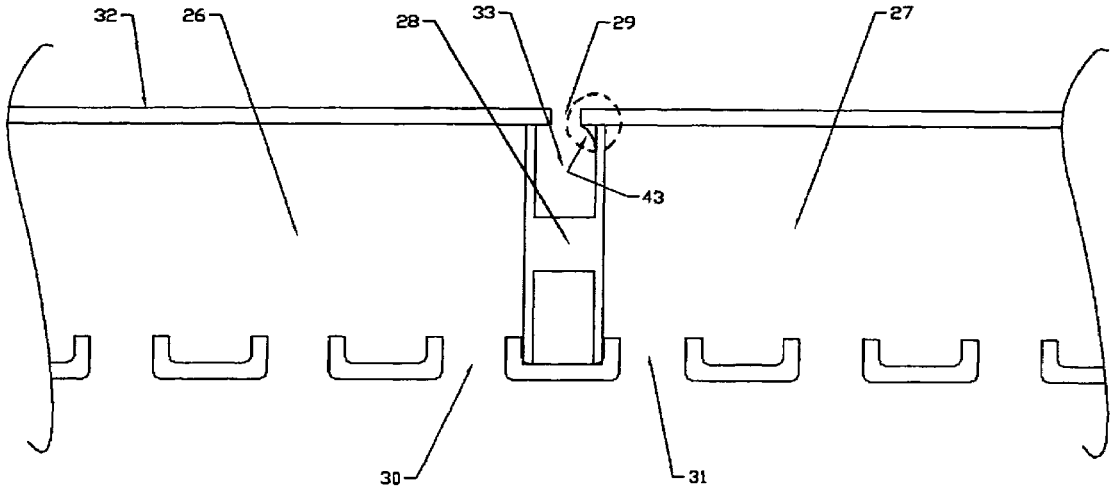
FIG. 6 is a perspective and cross sectional view of a heat exchanger comprising a single piece double baffle, in accordance with an aspect of the present invention.

Referring to FIG. 6, a manifold or end tank (32) is shown, with single piece double baffle (28) provided between two tube slots for tubes (30, 31). The first heat exchanger portion (26) wherein a first fluid can be found when in operation, and the second heat exchanger (27) portion wherein a second fluid can be found when in operation, are demonstrated. Gap or chamber (33) is illustrated, and a weep hole (29) is shown. A braze joint (43) between the baffle and the end tank is also illustrated.

Figure 7:
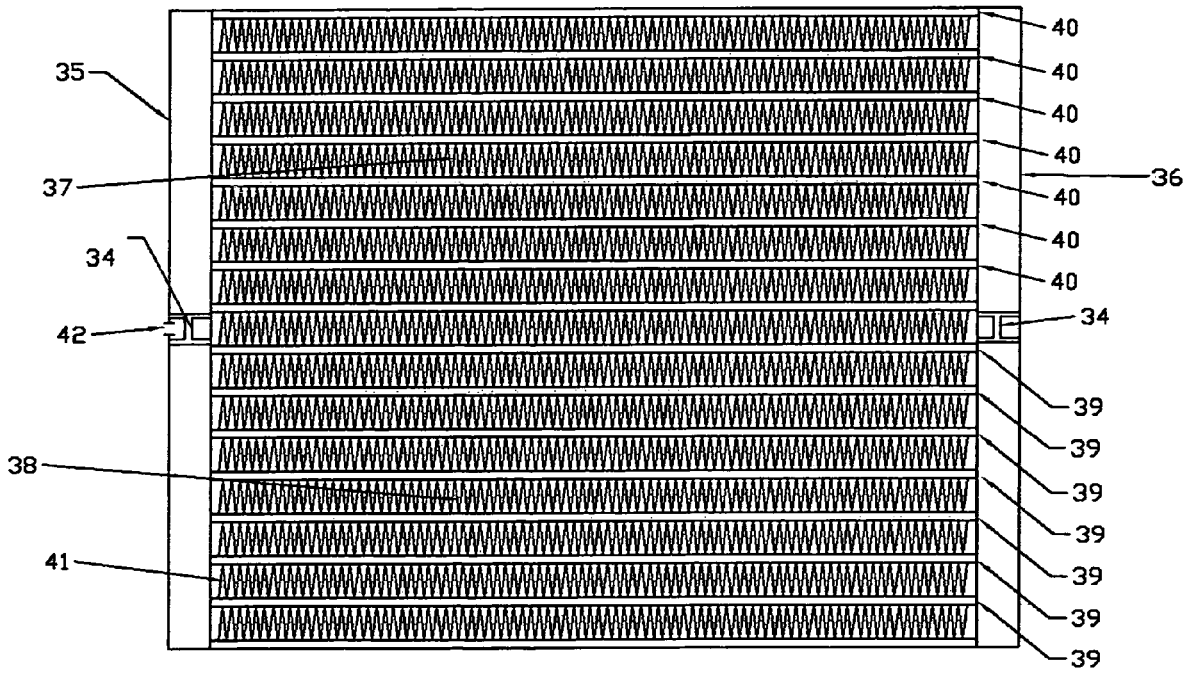
FIG. 7 is a perspective view of spaced single piece double baffle in an automotive heat exchanger in accordance with an aspect of the present invention.

Referring to FIG. 7, a heat exchanger as found in automotive vehicles and applications is provided. A single piece double baffle (34) is located within the end tanks (32, 36). The heat exchanger for heat exchange using one first fluid and one second fluid is shown (37, 38). Both fluids may be the same or different, preferably they are different. Tubes (39) for the heat exchanger wherein the second fluid is found when in operation and tubes (40) for the heat exchanger wherein the first fluid is found when in operation are shown, as well as fins (41), and weep hole (42).

From the above, it will thus be appreciated that the present invention, in preferred embodiments contemplates providing a multi-fluid heat exchanger assembled in a common assembly; passing a first fluid through one portion of the heat exchanger for heat exchange, and passing at least one additional fluid through at least one additional portion of the heat exchanger for heat exchange of the additional fluid, whereby saving space and cost by allowing for a single assembly of parts performing heat exchanger functions rather than two separate heat exchangers.

Preferably, a heat exchanger in accordance with the present invention includes at least one single piece double baffle, more preferred a plurality of single piece double baffles, also more preferably two single piece double baffles per interface between heat exchanger fluid sections, one single piece double baffle per heat exchanger manifold, (e.g. two single piece double baffles for an exchanger containing two fluids and four single piece double baffles for an exchanger containing three separate fluids), for dividing a region within a component of a heat exchanger into two or more portions. The single piece double baffle utilized in heat exchangers of the present invention may be provided in a variety of different shapes and having a variety of configurations depending upon which component of the heat exchanger the baffle is to be placed within and also depending, for instance, upon the configuration of that component.

Another advantage of the single piece double baffle, as found in the present invention, is that it can detect leaks across a flow dividing partition in a single fluid exchanger, in a condenser, for example.

According to one preferred embodiment, the portions separated by a single piece double baffle are part of an internal opening within an end tank of the heat exchanger. According to a highly preferred embodiment, the single piece double baffle, is employed to separate the respective portions in a multi-fluid heat exchanger wherein each of the subdivided portions is adapted to receive the same fluid under different conditions, or different fluids. As to the latter, for example, one portion may receive a first fluid (e.g., a condenser fluid or the like) while the other portion receives a second fluid (e.g., a transmission oil or power steering oil), which is different from the first fluid. In this manner, the use of baffles allows different fluids of a multi fluid heat exchanger to be maintained separate from each other as they flow through the heat exchanger. In preferred embodiments, the double baffle is a single piece double baffle that is asymmetric, or symmetric, or when there is a plurality of single piece double baffles, at least one baffle is symmetric or asymmetric, based on the space allowed in the manifold.

In preferred embodiments of the present invention, as described herein, the heat exchanger may be produced by a variety of methods. Heat exchangers that have components that are brazed together are known as brazed heat exchangers for the purpose of the present invention.

It may be possible to achieve the desired resulting structure using any of a number of art-disclosed forming techniques. Particularly preferred methods start off with one continuous piece of material. For example, a coining, casting, machining or other suitable operation may be employed. According to one preferred embodiment, the single piece double baffle is formed by attaching (preferably, for example, with a weld, a braze, or a solder material, or the like) two substantially identical metal pieces, or, more preferably, taking a continuous piece of material, such as a sheet metal and folding it together in mirror symmetrical relation to each other.

For one preferred embodiment of the present invention, a single piece double baffle is made by an extrusion and machining operation. An extrusion die in the shape of the interior of the heat exchanger manifold is made. The die allows for a long bar of material to be extruded in the shape and size of the interior of the heat exchanger manifold. The bar is then placed in a lathe, and spun approximately around its center of gravity along the long axis of the bar. The gap between the portions of the single piece double baffle is created in this lathe-spinning operation. Once the gap is formed, the single piece double baffle is cut from the bar, and the next baffle made. At this point the single piece double baffle is ready to be placed in a heat exchanger manifold. The baffle is placed inside the manifold either manually or with an automated machine. In either method there is a need for only one double baffle to placed in a particular area, rather than two, as shown in the prior art. Another additional advantage of the single piece double baffle is that, due to the small relative size of the heat exchanger manifold and the tight area in which to assemble the double baffle to said manifold, it can be used where it would be difficult to assemble two double baffles in a particular area.

Another method of manufacturing single piece double baffle in accordance with the present invention is to form the shape in a single step, rather than extruding and then machining. This step is done by casting, sintering, or other processes whereby the metal forming operation produces the desired shape of single piece double baffle without the need for significant amounts of further metal forming or machining.

It will be appreciated that the peripheral surface of the double baffle preferably has a shape that complements the end tank, so that the peripheral surface is substantially engaged with the inner wall surface of the end tank about the peripheral surface, thereby facilitating sealing as desired between end tank subdivided sections or portions.

In one highly preferred embodiment, the baffle or double baffle is adapted to provide for leak detection or for otherwise assuring seal integrity. To do so, it is preferred that the end tank be provided with at least one relief means. During assembly, the baffle is positioned so that the through-hole is substantially juxtaposed with the channel of the baffle. In this manner, it will be appreciated that if there is a faulty seal between portions of the end tank, fluid from that portion will enter the channel and exit through the through-hole, commonly called a 'weep hole'. The fact of a leak is then detectable by the fluid escape. The location of the faulty seal is also pinpointed by analyzing the escaped fluid to determine from which portion of the end tank it originated.

It is contemplated that various techniques may be used to secure the single piece double baffle within the end tank. For example, the one piece double baffle may be interference fitted within the tank, thereby preventing passage of fluid past the double baffle. Alternatively, the double baffle may be adhesively bonded at its peripheral surface to the end tank. In a highly preferred embodiment, the outer peripheral surface of the double baffle substantially corresponds to an inner surface of the end tank such that the outer peripheral surface and the inner surface substantially continuously oppose and contact each other. Accordingly, the outer peripheral surface may be attached to the inner surface by welding, brazing or the like.

A further advantage of this single piece double baffle comes in this securing to the manifold in preparation for brazing. Two piece double baffles are, by their vary nature unstable, as they consist of a thin piece of metal that whose diameter is significantly larger than its thickness. This makes a two piece double baffle difficult to hold in position, requiring additional tooling, adhesives, metal forming operations and the like to hold it in the proper position before brazing.

The single piece double baffle alleviates many of these difficulties, as the overall width of the single piece double baffle is significantly larger than that of the two piece double baffles, on the order of at least two times as wide, allowing for more stability when placed in the manifold. This means that while the two piece double baffle has in effect only two points of contact (at the header and at the cover) the single piece double baffle has, for example, four points of contact with the manifold (two on the header and two at the cover), thus preventing rotation of the single piece double baffle.

Advantageously, the single piece double baffle provides good resistance to pressures, or pressure fluctuations provided by fluids within the portions of the end tank, particularly in a preferred embodiment that includes two plates integrated for reinforcing each other. Also advantageous, the double baffle can provide fluid tight seals separated by a cavity since the outer peripheral surface is separated into portions by the cavity. Thus, each of the seals can buffer the other from pressure fluctuations thereby providing greater overall sealing between the portions of the end tank. As an added advantage, the single piece double baffle is relatively thin and is without thick rolled edges. As a result, it requires less volume to perform its function. The single piece double baffles are thus fit between tube entrances and exits to the end tank without interfering with flow of fluid through the tubes. The flexibility in mounting also helps to assure that the presence of dead tubes or other tube inefficiencies can be avoided.

The present invention also relates to methods for making a single piece double baffle for use in an automotive heat exchanger having a one piece double baffle comprising: forming a bar of metal or metal alloy to follow the contour of a heat exchanger manifold; cutting or machining the formed metal to width; machining the formed metal to provide for a gap large enough that it cannot be full filled with liquid material such as braze material or flux at the time of production and/or assembly of the heat exchanger. Also preferred are methods using extrusion for making a single piece double baffle for use in an automotive heat exchanger having a one piece double baffle comprising: making an extrusion die appropriate for forming a bar of material in the approximate shape and size of the interior of the heat exchanger; locating the bar of material in turning equipment (such as a lathe); spinning the bar of material or a cutting tool along the long axis of the bar; forming the bar of material into appropriate sized and shaped portions for single piece double baffles; creating a gap between the walls of the portions of material; and cutting off a single piece double baffle from the turned bar.

In particularly preferred methods in accordance with an aspect of the present invention, a single piece double baffle for use in an automotive heat exchanger having a one piece double baffle is made by: heating a metal up to a level where it may be forcibly formed or, if not forcibly formed, to approximately equal to or above its metal point; forming the metal into a one piece double baffle shape; and providing a gap between the walls of the one piece double baffle shape.

Other embodiments of baffles other than the ones described above are also within the scope of the present invention, including but not limited to the additional preferred embodiments that are described in the following discussion.

Generally, it is contemplated and, in fact, expected that various changes may be made to the preferred embodiments of the baffles and single piece double baffles employed in embodiments of the present invention to accommodate different designs of heat exchangers while still remaining within the scope of the present invention. As an example, and referring to FIG. 5, there is illustrated a single piece double baffle which is asymmetric. Such a double baffle would preferably rest within an end tank of a heat exchanger. As indicated previously, the baffles of the present invention are useful in a number of different applications. In one preferred use an end tank for a multi-fluid heat exchanger is provided and is subdivided with at least one single piece double baffle in accordance with the present teachings. In another embodiment, at least one single piece double baffle, as described herein, is employed to subdivide an end tank of a single fluid heat exchanger. The present baffles need not be used only to subdivide end tanks, but may be used to subdivide any structure that provides a fluid passageway. In still another preferred embodiment, the spacing varies to a wider position beyond the tube slot area in order to allow an enlarging of the hole dimension.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heat exchanger, comprising:

a first end tank;

a second end tank opposite the first end tank;

a plurality of first tubes in fluid communication with the first and second end tanks;

a plurality of second tubes in fluid communication with the first and second end tanks;

a plurality of fins disposed between the first and second tubes, with the first and second tubes and the fins being generally co-planar relative to each other; and at least one single piece double baffle in at least one of the end tanks;

wherein the single piece double baffle divides at least one end tank into a first portion and a second portion;

wherein the single piece double baffle has portions with walls, the portions with walls either 1) being symmetric about the centerline of the baffle, 2) essentially following the contours of the interior of the end tank, or 3) having a combination of both;

and wherein the walls of the single piece double baffle define at least one gap or chamber, the gap or chamber being shaped such that the single piece double baffle substantially has an H shape, the single piece double baffle including a center section disposed between the baffle walls, the center section being thicker than a thickness of one of the baffle walls.

2. The heat exchanger as in claim 1, further comprising a junction between the baffle and a portion of the end tank next to the baffle.

3. The heat exchanger as in claim 2 wherein the heat exchanger is a brazed heat exchanger.

4. The heat exchanger as in claim 3, wherein the junction is a braze joint and the gap between the walls of the baffle is at least twice the radius of the braze joint.

5. The heat exchanger as in claim 1, wherein the gap or chamber forms bends in the single piece double baffle.

6. The heat exchanger as in claim 1, wherein the single piece double baffle is made out of a flat or planar section or piece of material, or one piece of continuous material.

7. A heat exchanger, comprising:

a first end tank;

a second end tank opposite the first end tank;

a plurality of first tubes in fluid communication with the first and second end tanks, the plurality of first tubes adapted to have a first fluid flow therethrough;

a plurality of second tubes in fluid communication with the first and second end tanks, the plurality of second tubes adapted to have a second fluid flow therethrough;

a plurality of fins disposed between the first and second tubes, with the majority of fins being generally co-planar relative to each other; and at least one single piece double baffle in the first end tank and the second end tank;

wherein the at least one single piece double baffle in the first end tank and the second end tank divides both the first end tank and the second end tank into a first portion and a second portion;

wherein the single piece double baffle has portions with walls, the portions with walls either 1) being symmetric about the centerline of the baffle, 2) essentially following the contours of the interior of the end tank, or 3) having a combination of both;

and wherein the walls of the single piece double baffle define at least one gap or chamber, the gap or chamber being shaped such that the single piece double baffle substantially has an H shape, the single piece double baffle including a center section disposed between the baffle walls, the center section being thicker than a thickness of one of the baffle walls.

8. The heat exchanger as in claim 7 having a plurality of third tubes in fluid communication with the first and second end tanks, the plurality of third tubes adapted to have a third fluid, different from the first or second fluid, flow therethrough.

9. The heat exchanger as in claim 7 wherein the heat exchanger is made by brazing or soldering.

10. The heat exchanger as in claim 9 having a junction between the one piece double baffle and the end tank, the junction being formed between the baffle and a portion of the end tank next to the baffle.

11. The heat exchanger as in claim 10, wherein the junction is a braze joint and the gap between the walls of the baffle is at least twice the radius of the braze joint.

* * * * *